US005480519A

United States Patent [19]

Abbott et al.

[11] Patent Number: 5,480,519

[45] Date of Patent: Jan. 2, 1996

[54] ELECTROCHEMICAL ETCH SYSTEM AND METHOD

[75] Inventors: Donald C. Abbott, Norton; George A. Dainis, III, Mansfield; David W. West, Pembroke, all of Mass.

[73] Assignee: Texas Instruments Incorporated, Dallas, Tex.

[21] Appl. No.: 384,041

[22] Filed: Feb. 6, 1995

[51] Int. Cl.[6] ..... C25F 3/02; C25F 7/00

[52] U.S. Cl. ..... 204/129.35; 204/129.65; 204/129.75; 204/224 M; 204/275

[58] Field of Search ..... 204/129.65, 129.75, 204/224 M, 206, 284, 129.35, 129.55; 156/651, 665, 659.1

[56] References Cited

U.S. PATENT DOCUMENTS 4,294,680 10/1981 Lincoln et al. ..... 204/224 R 5,167,794 12/1992 Ito ..... 204/129.35 X 5,284,554 2/1994 Datta et al. ..... 204/129.65 X

*Primary Examiner*—Donald R. Valentine

*Attorney, Agent, or Firm*—W. James Brady, III; Richard L. Donaldson

[57] ABSTRACT

A method and apparatus for forming lead frames and eliminating irregularities in the edge (22) of openings etched in the sheet metal from which the lead frame is formed. In a first process, a photo resist coated metal sheet (36) is first etched by a photo chemical process to define the lead frame, and then the lead frame metal sheet (36) is etched in an electrochemical process to remove edge irregularities. In a second process, the entire lead frame is formed in an electrochemical process.

18 Claims, 4 Drawing Sheets

ELECTROCHEMICAL ETCH SYSTEM AND METHOD

FIELD OF THE INVENTION

This invention relates to semiconductor devices, and more particularly to a system and method of electrochemical etching of lead frames for semiconductor devices.

BACKGROUND OF THE INVENTION

Standard photochemical etching when done simultaneously from both sides of a metal sheet produces an hourglass shaped edge profile. This hourglass shaped edge, referred to as "foot" is undesirable in etched lead frames and impairs the functionality of the finished product. Lead frames may also be stamped, but by etching, smaller openings or spaces may be made in the lead frame. The edge "foot" produced by standard photochemical etching leaves small projections extending into the openings and does not produce a smooth edge.

SUMMARY OF THE INVENTION

The invention is to a method and system wherein lead frames for semiconductor devices are made by photochemically etching a metal sheet to define a lead frame having openings therein with said openings defined by edges, and then electrochemically etching the defined lead frame opening to eliminate irregularities in said edges, or alternately, etching a metal sheet electrochemically to define a lead frame without edge irregularities.

The technical advance represented by the invention, as well as the objects thereof, will become apparent from the following description of a preferred embodiment of the invention when considered in conjunction with the accompanying drawings, and the novel features set forth in the appended claims.

DESCRIPTION OF A PREFERRED EMBODIMENT

Figure 1:
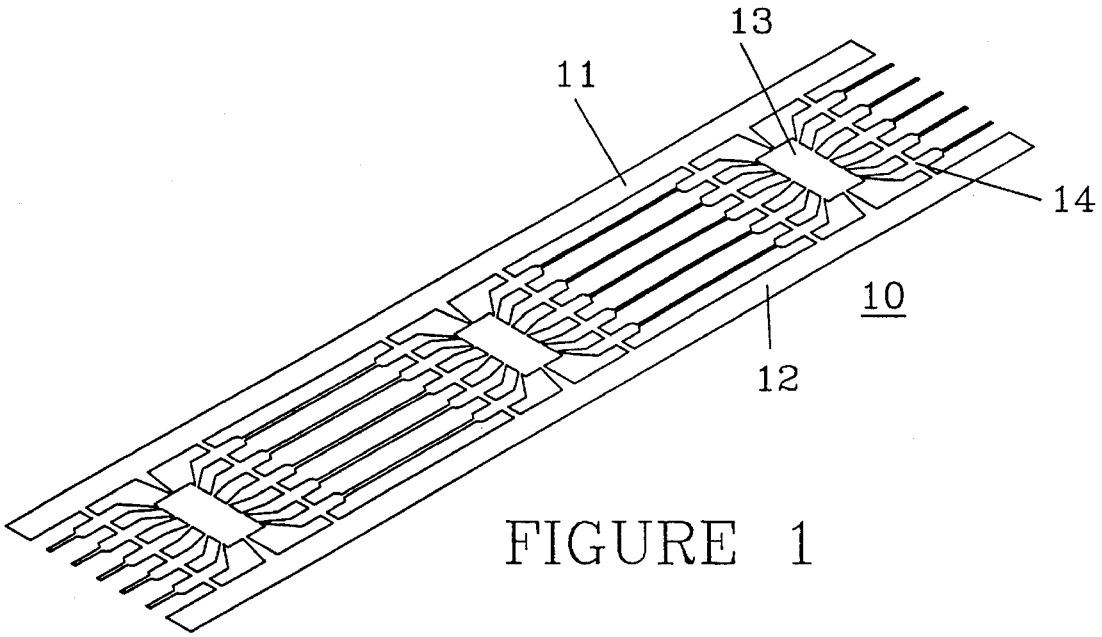
FIG. 1 shows a typical semiconductor lead frame.

FIG. 1 shows a typical strip of multiple lead frames that have been produced either by stamping or etching. When smaller spaces between lead frame parts are made, etching is desirable. Etching is also desirable when low cost and quick tooling are required, and especially for short production, pilot and experimental runs. Lead frame 10 shows multiple lead frames attached together by side rails 11 and 12. Each lead frame has a die mount pad 13 and a plurality of leads 14. When the lead frames are first formed, there are interconnecting metal parts between the die pad and leads to hold the parts together until the lead frames are separated. Separation often occurs after a semiconductor die has been mounted on die mount pad 13, and lead wires have been connected between the leads and the semiconductor die, and the center part of the lead frame is encapsulated in plastic.

The production of lead frames by standard photochemical etching is usually accomplished by etching from one side or simultaneously from both sides of a base metal sheet which has portions of the resultant lead frame covered with a resist. Through a photo process and development, portions of the photo sensitive resist are exposed and then removed, and the base metal in the areas where resist is removed is etched away leaving the lead frame.

Figure 2:
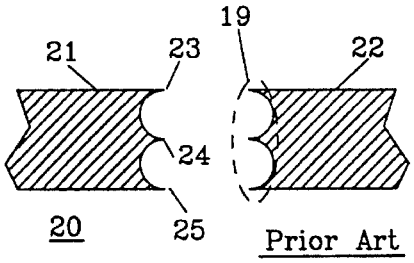
FIG. 2 show the "Foot" formed in standard photochemical etching.

FIG. 2 is a cross sectional view of a lead frame part, such as a lead or the edge of the die pad, that has been made by standard photochemical etching from both sides of a metal sheet.

In the standard photochemical etching process, a metal sheet is covered with a photo resist material that is covered with a mask having the lead frame pattern thereon. The photo resist material is exposed to light through the mask, and portions of the photo resist material are removed by a photo development process, exposing the parts of the metal sheet that are to be etched away to form the lead frame. Corrosive chemical etchants such as ferric or cupric chloride are used in the etching process.

Lead frame parts 21 and 22 show that when the lead frame material is etched though by photochemical etching, an hourglass shaped edge 19 profile is produced. There are three "peaks" produced in the cross section. Two of the peaks, 23 and 25, are at the surface of the lead frame. A third peak, referred to as a "foot" is at the center of the etched region. The peaks result from the fact that the enchant not only etches down from the top of the lead frame metal, and up from the bottom of the lead frame metal, when simultaneously etching from both sides, but the etchant also etches and removes metal in a horizontal direction into the body of the lead frame material. To eliminate or reduce the "foot" produced by photochemical etching, additional etching would etch further horizontally into the lead frame material.

Figure 3:
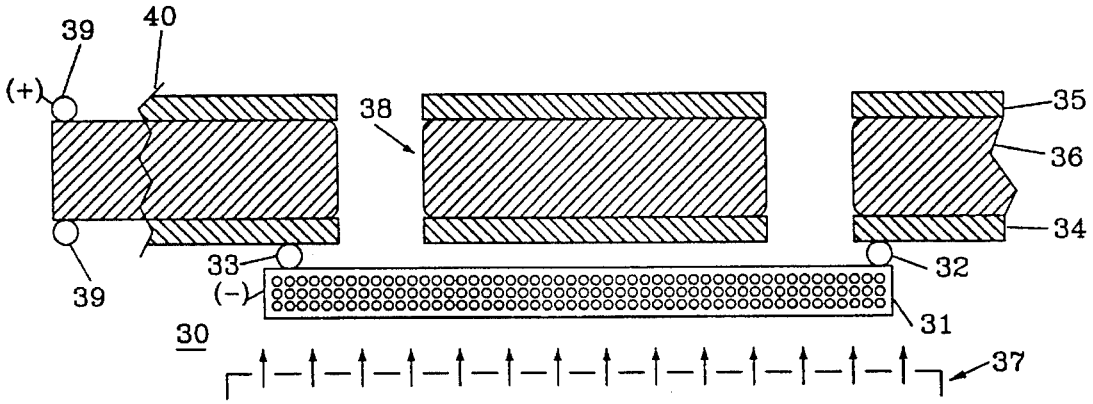
FIG. 3 shows the etching system utilized in the present invention.

FIG. 3 is a pictorial representation of an electrochemical system 30 that is used to minimize or eliminate the "foot" and surface projections caused by photochemical etching. The electrochemical system 30 consists of: a perforated cathodic plate 31 of, for example, titanium, stainless steel, or other similar metal; a guide system 32,33 of, for example plastic, ceramic, or similar material, to position the lead frame strip 36 above cathodic plate 31; an anodic contact system, 39, which may be rollers, brush or sliding contact; and a sparger or jet manifold 37 to supply electrolyte for use in individual panel or reel-to-reel etching equipment. The sparger may be the cathode. There may be a sparger/cathode on both sides of the lead frame strip. The entire apparatus is submerged in an electrolyte.

The invention has two aspects. First the "foot" removal process is applied to lead frames that have been produced by photochemical etching. If the lead frame is produced by electrochemical etching, then the lead frame is produced by a direct process of electrochemically etching, and no "foot" irregularity is formed.

In the "foot" removal process, where the lead frame has been produce by first chemically etching the photo resist patterned metal sheet, the lead frame metal 36, with photo resist material 34 and 35 on both sides, is moved past perforated cathodic plate 31 and spray sparger 37. The anode contact to the lead frame metal is made by anode contacts 39 directly to the lead frame metal 36. A part of the photo resist, at the edges of the lead frame, has been removed as shown at 40 to provide the direct electrical contact to lead frame metal 36. An electrolyte such as HCl, $NaNO_3$ or NaCl is introduced from one side of the lead frame strip via, for example sparger system 37, and a current, DC or pulsed, is applied from the lead frame metal at anode 39 to perforated cathode plate 31. The system design is such that with the photo resist 34, 35 still on the surface of the lead frame metal 36, and the sparger system directly over the etched openings, a foot such as foot 24 shown in FIG. 2 receives a concentrated portion of the electrolyte action and current from the anode to the cathode of the system results in preferential dissolution of the base metal of the lead frame, removing the "foot" 24 and surface projections 23 and 25 illustrated in FIG. 2. The resulting cross-section of the lead frame metal is shown in FIG. 3, as indicated at 38, where the foot 24 and surface projection 23 and 25 of FIG. 2 have been removed.

Figure 4:
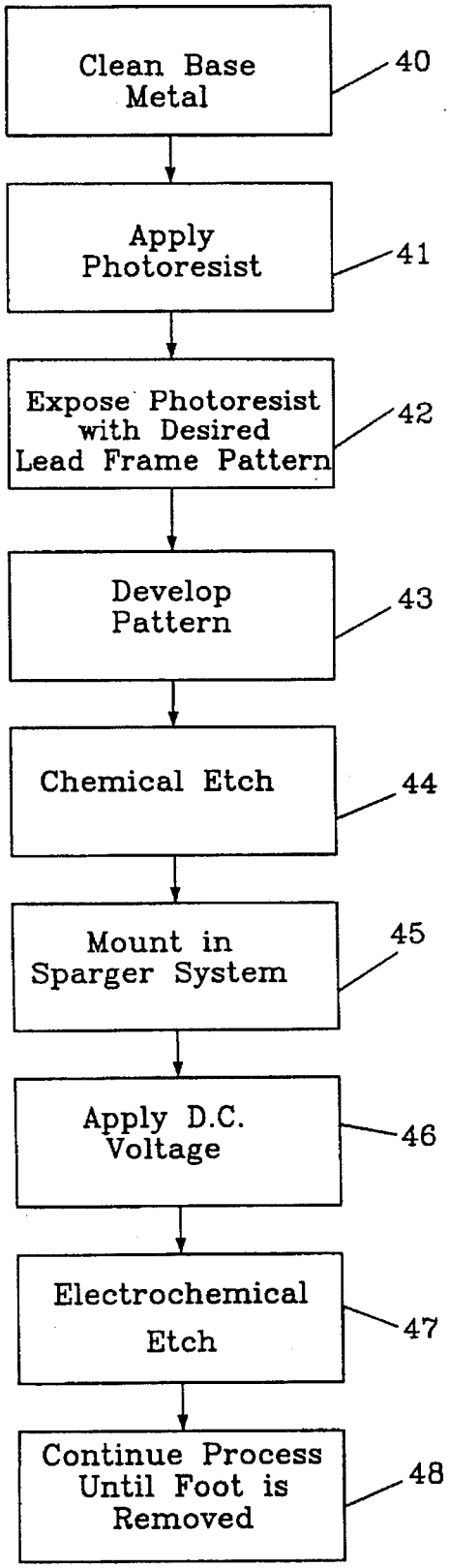
FIG. 4 shows the process steps of a first embodiment of the invention.

FIG. 4 is a flow diagram of the basic process steps where the lead frame is produce by first photochemical etching, and then the "foot" is removed by electrochemical etching. A base metal strip is cleaned (Step 40) and photo resist is applied over the base metal (Step 41). The photoresist is then exposed defining a desired lead frame pattern (Step 42). A developing process removes unwanted areas of photoresist, defining the lead frame pattern on the base metal ( Step 43). The exposed parts of the metal sheet are removed by chemical etching (step 44). Next, the photo resist coated and etched metal sheet is passed by a sparger system and a perforated cathode (step 45). A D.C. current is then connected between the metal sheet (the anode) and the perforated cathode (step 46). An electrolyte such as HCl, $NaNO_3$ or NaCl is introduced from one side of the lead frame sheet metal, from sparger 37 through the previously etched openings in the lead frame metal (step 47), and the etch process is continued until the "foot" is removed from the sheet metal cross section (step 48).

Figure 5:
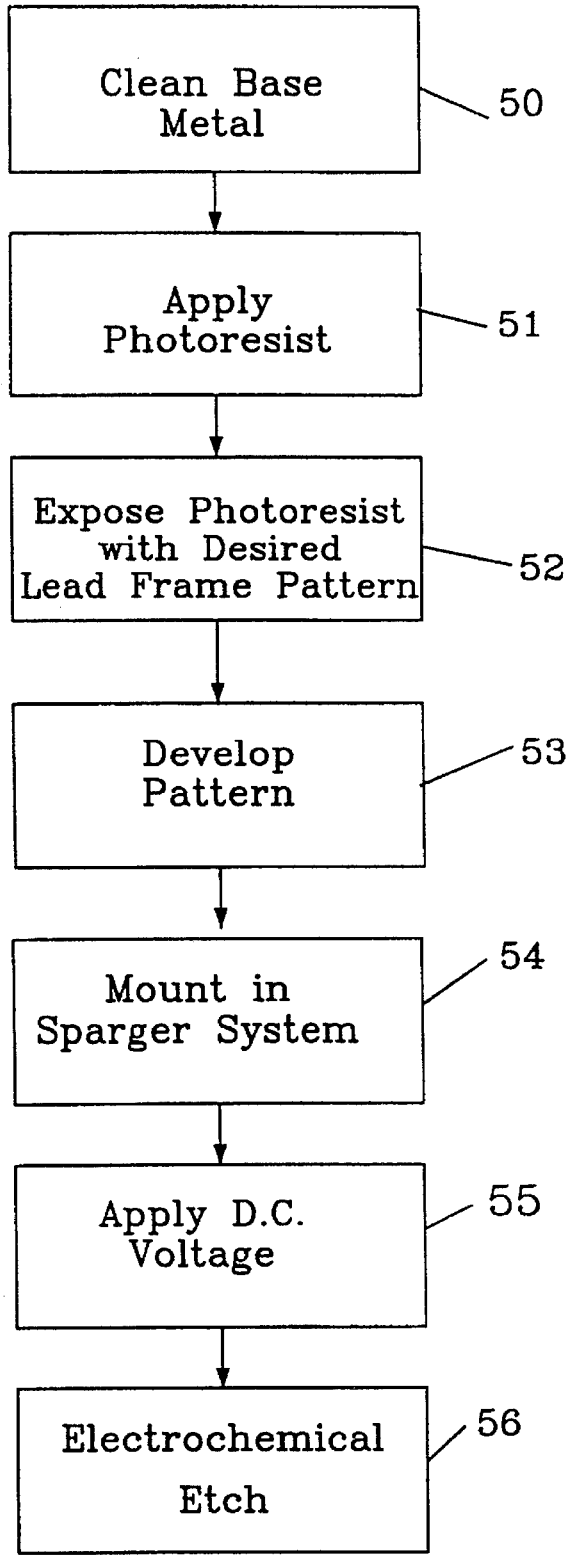
FIG. 5 shows the process steps of a second embodiment of the invention.

The lead frame can be produced by utilizing only a electrochemical etch process. This process is illustrated in FIG. 5, and the basic system is illustrated in FIG. 3. A base metal strip is cleaned (Step 50) and photo resist is applied over the base metal (Step 51). The photoresist is then exposed defining a desired lead frame pattern (Step 52). A developing process removes unwanted areas of photoresist, defining the lead frame pattern on the base metal (Step 53). The coated metal sheet is positioned under a sparger and an electrolyte, for example HCl, $NaNO_3$ or NaCl, is sprayed on the metal sheet etching through the uncoated areas on the metal sheet forming the lead frame free of edge irregularities (step 54). An electrical potential is placed across the metal sheet, at anode 39, utilizing an uncoated contact on the metal sheet as the anode, and a perforated cathode 31 (Step 55).

The electrolyte is introduced from one or both sides of the metal/resist system and current, DC or pulsed, is applied from the metal sheet to the perforated cathode (Step 56). There may be only one cathode, or there may be a cathode on both sides. By concentrating the current flow through the uncoated parts of the metal sheet, the metal sheet is etched producing a smooth edge at the etched holes in the metal sheet, resulting in a lead frame with edges having a "foot" free edge as illustrated at 38 in FIG. 3.

In the example given above, the electrolyte is sprayed onto the photo resist coated sheet metal. However, the entire system, sparger, coated sheet metal and cathode(s) may be submerged in an etch tank.

In the first example, the process has been adapted to utilize a previous photochemical process that etches from both sides of the lead frame metal. However, a preliminary etching may be accomplished from only one side of the lead frame metal, thus eliminating one-half of the photo resist material, requiring only one photo mask plate, eliminating the need for top to bottom alignment of the masks when etching from both sides of the lead frame metal. In the second example utilizing only electrochemical etching, single sided etching may also be used.

The two step process, photochemical etch and electrochemical etch provides a cost reduction by replacing oxidizing agents such as cupric or ferric chloride with common table salt (NaCl) or $NaNO_3$, or similar salts, or acids, in the foot removal process. There is further major cost reduction in the second method by eliminating the need for waste treatment of such chemicals as ferric or cupric chloride which are used in the photochemical etch process when the lead frame is produced solely by the electrochemical etching process.

What is claimed is:

1. A method for making lead frames for semiconductor devices, comprising the steps of:

photochemically etching a metal sheet to define a lead frame having openings therein with said openings defined by edges;

electrochemically etching the defined lead frame opening to eliminate irregularities in said edges.

2. The method according to claim 1, including the step of photochemically etching said sheet metal from two sides.

3. The method according to claim 1, including the step of defining the lead frame openings by a photo resist material.

4. The method according to claim 1, wherein said electrochemically etching is accomplished by an electrolyte selected from HCl, $NaNO_3$ and NaCl.

5. The method according to claim 1, including the step of providing a D.C. current from the lead frame to a perforated cathodic plate to concentrate a current at edge irregularities to provide for preferential dissolution of lead frame edge metal irregularities.

6. The method according to claim 5, wherein electrolyte is introduced from one side of the lead frame during dissolution of the edge irregularities.

7. A method for producing a lead frame, comprising the steps of:

defining a lead frame pattern on a metal sheet with a photo resist material removing the photo resist material from selected areas on the metal sheet to expose portions of the metal sheet to be removed;

chemically removing the exposed portions of the metal sheet to form the lead frame which has edges with irregularities adjacent to the removed portions of metal sheet;

mounting the lead frame between a sparger system and a cathode;

electrochemically etching the edges to remove irregularities from said edges.

8. The method according to claim 7, including the step of moving the lead frame adjacent to the sparger system and cathode.

9. The method according to claim 7, including the step of photochemically etching said sheet metal from two sides.

10. The method according to claim 7, wherein said electrochemically etching is accomplished by an electrolyte selected from HCl, $NaNO_3$ and NaCl.

11. The method according to claim 7, including the step of providing a current from the lead frame to the perforated cathodic plate to concentrate a current at edge irregularities to provide for preferential dissolution of lead frame edge metal irregularities.

12. The method according to claim 11, wherein electrolyte is introduced from one side of the lead frame during dissolution of the edge irregularities.

13. A method for producing a lead frame, comprising the steps of:

defining a lead frame pattern on a metal sheet with a photo resist material removing the photo resist material from selected area on the metal sheet to expose portions of the metal sheet to be removed;

mounting the lead frame metal sheet between a sparger system and a cathode;

electrochemically etching exposed portions of the sheet metal to remove the selected areas to form said lead frame.

14. The method according to claim 13, wherein said electrochemically etching is accomplished by an electrolyte selected from HCl, $NaNO_3$ and NaCl.

15. The method according to claim 13, including the step of providing a D.C. current from the lead frame sheet metal to the perforated cathodic plate to concentrate a current through the area to be remove.

16. The method according to claim 13, wherein electrolyte is introduced from one side of the lead frame during dissolution of the edge irregularities.

17. The method according to claim 13, wherein said lead frame metal sheet, sparger system and cathode are submerged in an etching tank during the formation of said lead frame.

18. A system for etching lead frames from a photo resist patterned metal sheet, comprising:

a electrolyte sparger system for supplying an electrolyte;

a perforated cathode positioned below said sparger system;

a guide system positioned above said cathode for guiding said photo resist patterned metal sheet between said sparger system and said cathode;

an anode for contacting said metal sheet; and a source of power for suppling a current from said anode through said metal sheet to said cathode via the electrolyte from said sparger system.

* * * * *